US011324299B2

(12) United States Patent
Chen et al.

(10) Patent No.: US 11,324,299 B2
(45) Date of Patent: May 10, 2022

(54) HANDHELD HAIR DRYING APPARATUS

(71) Applicant: Shenzhen Soocas Technology Co., Ltd., Shenzhen (CN)

(72) Inventors: Xu Chen, Shenzhen (CN); Xiongnan Jiang, Shenzhen (CN); Fandi Meng, Shenzhen (CN)

(73) Assignee: SHENZHEN SOOCAS TECHNOLOGY CO., LTD., Shenzhen (CN)

( * ) Notice: Subject to any disclaimer, the term of this patent is extended or adjusted under 35 U.S.C. 154(b) by 213 days.

(21) Appl. No.: 16/539,386

(22) Filed: Aug. 13, 2019

(65) Prior Publication Data

US 2020/0178666 A1 Jun. 11, 2020

Related U.S. Application Data

(63) Continuation of application No. PCT/CN2019/087806, filed on May 21, 2019.

(30) Foreign Application Priority Data

Dec. 6, 2018 (CN) ..... 201811486894.4

(51) Int. Cl.
*A45D 20/12* (2006.01)

(52) U.S. Cl.
CPC ..... *A45D 20/12* (2013.01)

(58) Field of Classification Search
CPC ..... A45D 20/12; A45D 20/00; A45D 20/10; A45D 20/04; A45D 20/08; A45D 20/122; F24H 3/0423

(Continued)

(56) References Cited

U.S. PATENT DOCUMENTS 4,972,065 A * 11/1990 Ohlsen ..... A45D 20/12 34/97
2015/0007442 A1* 1/2015 Gam ..... A45D 20/00 34/97
2016/0213122 A1* 7/2016 Sakuma ..... A45D 20/12

FOREIGN PATENT DOCUMENTS

CN 1081347 2/1994
CN 2211193 11/1995

(Continued)

OTHER PUBLICATIONS

"International Search Report (Form PCT/ISA/210) of PCT/JP2019/087806," dated Sep. 4, 2019, pp. 1-6.

(Continued)

*Primary Examiner* — Edelmira Bosques
*Assistant Examiner* — Bao D Nguyen
(74) *Attorney, Agent, or Firm* — Fredrikson & Byron, P.A.

(57) ABSTRACT

The present disclosure relates to the field of blowing equipment, more particularly, to a handheld hair drying apparatus which includes a handle, a main body and a controller. The handle includes a fluid inlet. The main body includes a housing, a tube body and a first end cover; the housing is connected to the handle; the tube body passes through the housing coaxially and is connected to the housing; the tube body has a first opening and a second opening opposite to each other, the first end cover enclosing the first opening; a first fluid outlet is formed between an end of the tube body where the second opening is located, the first fluid outlet communicating with the fluid inlet to form a first fluid channel; and the controller is arranged inside the tube body.

11 Claims, 4 Drawing Sheets

(58) Field of Classification Search
USPC ..... 34/97
See application file for complete search history.

(56) References Cited

FOREIGN PATENT DOCUMENTS

| | | | | |
|---|---|---|---|---|
| CN | 104510138 | | | 4/2015 |
| CN | 105407756 | | | 3/2016 |
| CN | 205963256 | | | 2/2017 |
| CN | 206499079 | | | 9/2017 |
| CN | 107307558 | | | 11/2017 |
| CN | 107307558 | A | * | 11/2017 |
| CN | 206687363 | | | 12/2017 |
| CN | 109452744 | | | 3/2019 |
| EP | 2497385 | | | 4/2014 |
| JP | H0354166 | | | 5/1991 |
| JP | 2015013125 | | | 1/2015 |

OTHER PUBLICATIONS

"Written Opinion of the International Searching Authority (Form PCT/ISA/237) of PCT/JP2019/087806," dated Sep. 4, 2019, pp. 1-5.
"Office Action of China Counterpart Application", dated Oct. 28, 2019, p. 1-p. 6.
"Office Action of Korea Counterpart Application", dated Dec. 18, 2020, p. 1-p. 4.

* cited by examiner

HANDHELD HAIR DRYING APPARATUS

CROSS-REFERENCE TO RELATED APPLICATIONS

This application is a continuation of PCT application No. PCT/CN2019/087806, filed on May 21, 2019, which claims priority of Chinese Application No. 201811486894.4 filed on Dec. 6, 2018. The patent applications are hereby incorporated by reference in their entireties.

TECHNICAL FIELD

The present disclosure relates to the field of blowing equipment, more particularly, to a handheld hair drying apparatus.

BACKGROUND

With advancement of science and technology and ever-growing living standard, handheld hair drying apparatuses for hair drying and conditioning have been more and more widely used. A hair drying apparatus normally includes a controller for controlling outflow rate and outflow temperature of the handheld hair drying apparatus.

For a conventional handheld hair drying apparatus, the controller is normally located within the handle. However, the existing handheld hair drying apparatuses possess more and more functions, hence the size of the controller is bigger and bigger. If the controller is still arranged inside the handle, the handle needs to be thickened such that the handle may contain the controller therein. However, this makes the handheld hair drying apparatus unaesthetic, and inconvenient for users to hold.

SUMMARY

The present disclosure provides a handheld hair drying apparatus, aiming to solve arrangement problems of the controller of the handheld hair drying apparatus.

In order to solve the problems above, the present disclosure provides a handheld hair drying apparatus which includes:

a handle including a fluid inlet;

a main body including a housing, a tube body and a first end cover; the housing is connected to the handle; the tube body passes through the housing coaxially and is connected to the housing; the tube body has a first opening and a second opening opposite to each other, the first end cover enclosing the first opening; a first fluid outlet is formed between an end of the tube body where the second opening is located, the first fluid outlet communicating with the fluid inlet to form a first fluid channel; and a controller arranged inside the tube body.

Optionally, the tube body is configured with a flow-guiding hole; the flow-guiding hole communicates with the second opening to form a second fluid channel, the second fluid channel communicating with the first fluid channel.

Optionally, the handheld hair drying apparatus further includes a heater sheathing around the tube body and arranged between the flow-guiding hole and the second opening.

Optionally, the first end over is detachably connected to the tube body.

Optionally, the tube body includes a first portion and a second portion arranged coaxially, one end of the first portion connected to the housing, another end detachably connected to the second portion, wherein an end of the first portion connected to the housing is provided with the first opening; an end of the second portion distal to the first portion is provided with the second opening.

Optionally, the first portion is of horn shape; a smaller end of the first portion is connected to the second portion.

Optionally, the main body further includes a second end cover; the second end cover is connected to at least one of the tube body and the housing; at least part of the second end cover extends from the second opening to inside of the tube body, the second end cover and an inner wall of the tube body forming the second fluid outlet; the second fluid outlet is commutated with the second outlet; a confluence outlet is formed between the second end cover and an inner wall of the housing; the confluence outlet communicates with the first fluid outlet and the second fluid outlet.

Optionally, the second end cover is detachably connected to the tube body.

Optionally, the handle includes a first end and a second end arranged opposite to each other; the first end is provided with the first fluid inlet, the second end connected to the housing, a direction extending from the first end to the second end being perpendicular to that extending from the first opening to the second opening.

Optionally, the main body further includes a first flow-guiding element located within the first fluid channel and connected to the tube body; the first flow-guiding element is configured to guide the fluid inside the first fluid channel to flow from the first opening to the second opening within the housing.

Optionally, the first flow-guiding element includes a body, a first convex and a second convex, the body being connected to the tube body; the first convex and the second convex are arranged on the body, the first convex being opposite to the second convex.

Optionally, one end of the body distal to the second end bends along a direction from the first opening to the second opening.

Optionally, the body further includes a second flow-guiding element; the second flow-guiding element is arranged on another side of the tube body relative to the second end; the second flow-guiding element is configured to guide the fluid inside the first fluid channel to flow within the housing from the first opening to the second opening.

Optionally, two second flow-guiding elements are provided and arranged opposite to each other.

In the embodiments of the present disclosure, beneficial effects are as follows:

In the handheld hair drying apparatus described above, the controller is arranged inside the tube body, avoiding thickening the handle which may affect normal use resulting from arranging the controller inside the handle.

BRIEF DESCRIPTION OF THE ACCOMPANYING DRAWINGS

In order to explain the technical solutions of the present disclosure and of the prior art more clearly, the following drawings required in the description of the present disclosure and the prior art will be introduced briefly. Apparently, the following drawings merely represent some embodiments of the present disclosure. For those ordinarily skilled in the art, alternative drawings may be derived from the following drawings without paying creative works.

Reference numbers used in the specification are as follows;

100. Handle; 110. First end; 111. Fluid inlet; 120. Second end;

200. Main body; 210. Housing; 220. Tube body; 221. First opening; 222. Second opening; 223. Flow-guiding hole; 224. First portion; 225. Second portion; 230. First end cover; 250. Second end cover; 260. First flow-guiding element; 261. Body; 262. First convex; 263. Second convex; 270. Second flow-guiding element;

201. First fluid outlet; 202. First fluid channel; 203. Second fluid channel; 204. Confluence outlet; 205. Second fluid outlet;

300. Heater;

400. Controller;

500. Fan assembly.

DETAILED DESCRIPTION OF ILLUSTRATED EMBODIMENTS

Technical solutions of the embodiments of the present disclosure will be described clear and thoroughly in accompany with the drawings. Obviously, the embodiments described herein are merely some embodiments of the present disclosure instead of exclusive embodiments. Those skilled in the art may derive alternative embodiments from the embodiments of the present disclosure without paying creative works, which also fall into the scope of the present application.

Figure 1:
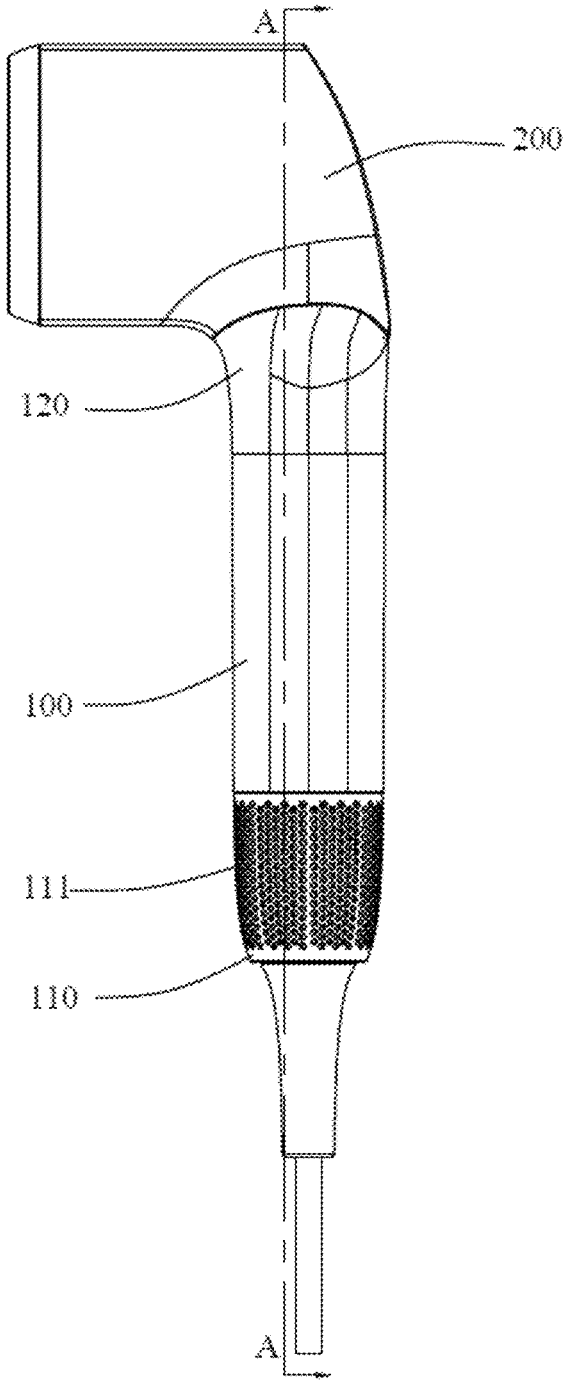
FIG. 1 is a structural view of a handheld hair drying apparatus according to an embodiment.
Figure 2:
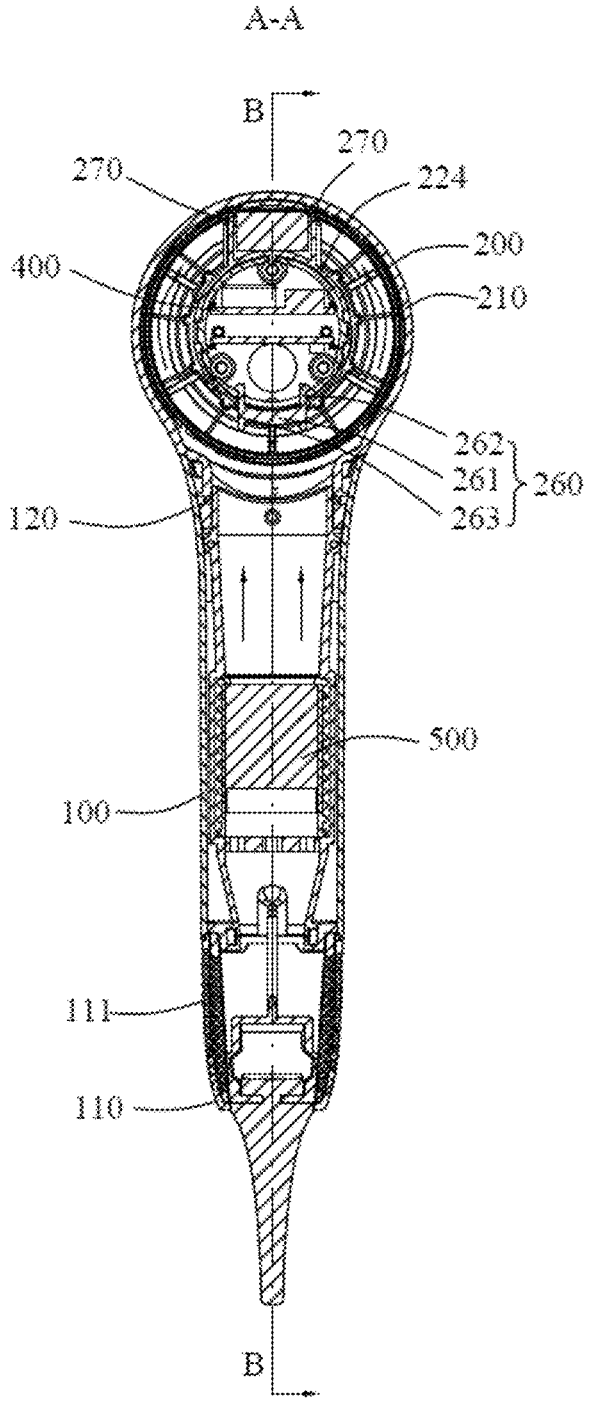
FIG. 2 is a section view cutting through an A-A direction in FIG. 1.
Figure 3:
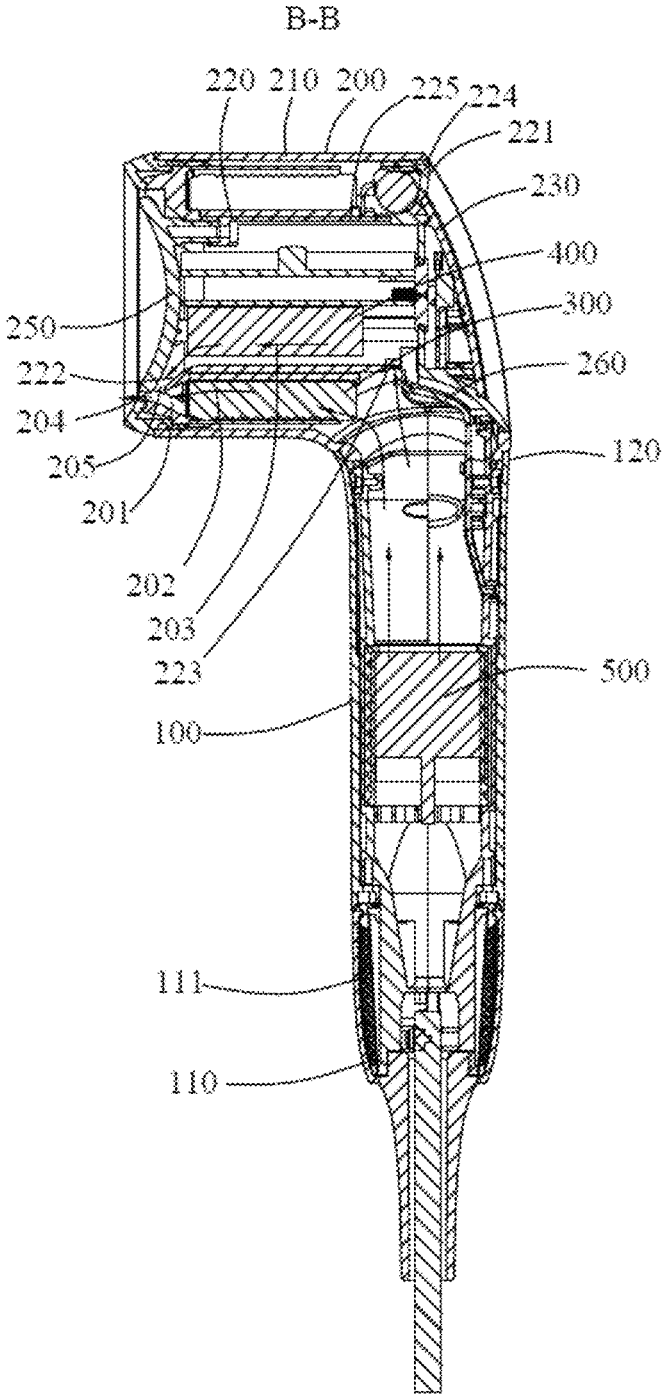
FIG. 3 is a section view cutting through a B-B direction in FIG. 2.

As shown in FIGS. 1-3, the present disclosure provides a handheld hair drying apparatus including a handle 100, a main body 200, a heater 300, a controller 400 and a fan assembly 500. The handle 100 includes a first end 110 and a second end 120 which are arranged opposite to each other. The first end 110 includes a fluid inlet 111, and the second end 120 is connected to the main body 200.

The main body 200 includes a housing 210, a tube body 220 and a first end cover 230. The tube body 220 passes through the housing 210 coaxially. The tube body 220 includes a first opening 221 and a second opening 222 arranged opposite to each other. The first opening 221 is enclosed by the first end cover 230 so as to avoid external objects from entering inside of the tube body 220 through the first opening 221. A first fluid outlet 201 is formed between one end of the tube body 220, where the second opening 222 is located, and the housing 210. The first fluid outlet 201 communicates with the fluid inlet 111 to form the first fluid channel 202. The heater 300 sheaths around the tube body 220 for heating up the fluid inside the first fluid channel 202.

The controller 400 is arranged inside the tube body 220 and electrically connected to the heater 300 and the fan assembly 500. The controller 400 may control heating temperature of the heater 300 and rotating speed of the fan assembly 500 so as to control outflow temperature and flow volume of the handheld hair drying apparatus. Therefore, the controller 400 may be avoided from being arranged inside the handle 100, thereby avoiding thickening the handle 100 and hence affecting normal use. Furthermore, since the heater 300 is arranged outside the tube body 220 and the controller 400 is arranged inside the tube body 220, the tube body 220 may avoid the thermal energy of the heater 300 from spreading to the controller 400, further prolong service time of the controller 400.

Furthermore, the tube body 220 is configured with a flow-guiding hole 223; the flow-guiding hole 223 communicates with the second opening 222 to form a second fluid channel 203, the second fluid channel 203 communicating with the first fluid channel 202. When the fluid inside the first fluid channel 202 flows into the housing 210, some of the fluid flows from the flow-guiding hole 223 into the second fluid channel 203, such that the controller 400 located inside the second fluid channel 203 may be dissipated, prolonging service time of the controller 400.

It's worth mentioning that in one embodiment, the heater 300 is located between the flow-guiding hole 223 and the second opening 222. Therefore, some fluid inside the first fluid channel 202 does not pass through the heater 300, instead, directly enters the second fluid channel 203, thereby enhancing dissipation effect of the controller 400 carried out by the fluid inside the second fluid channel 203.

Figure 4:
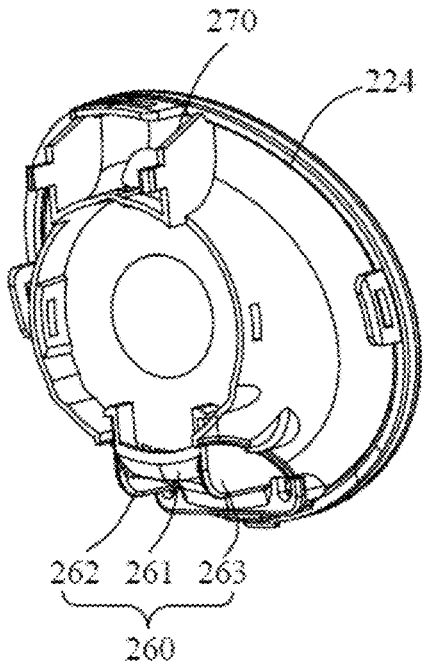
FIG. 4 is a local structural view of the handheld hair drying apparatus in FIG. 3.
Figure 5:
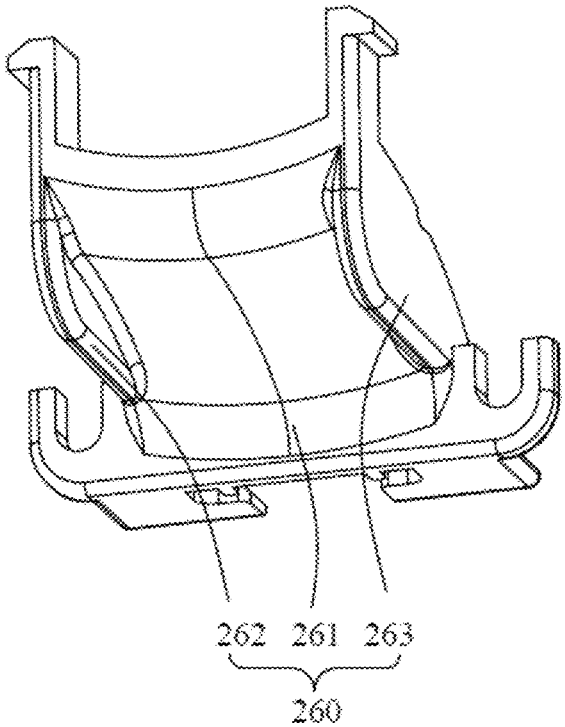
FIG. 5 is a structural view of a first flow-guiding element in FIG. 4.

In the present embodiment, as shown in FIGS. 3-4, the first end cover 230 is detachably connected to the tube body 220. Therefore, when the handheld hair drying apparatus is damaged, only by detaching the first end cover 230 may the controller 400 inside the tube body 220 be repaired.

Specifically, the first end cover 230 is provided with a recess, and an inner wall of the tube body 220 is provided with a convex. When the first end cover 230 is connected to the tube body 230, the convex in the inner wall of the tube body 220 is inserted into the recess of the first end cover 230. It is to be understood that in alternative embodiments, the first end cover 230 may be connected to the tube body 220 through other ways such as fasteners or threads.

Furthermore, as shown in FIG. 3, the tube body 220 includes a first portion 224 and a second portion 225 arranged coaxially. One end of the first portion 224 is connected to the housing 210, and another end detachably connected to the second portion 225. An end of the first portion 224 connected to the housing 210 is provided with the first opening 221; an end of the second portion 225 distal to the first portion 224 is provided with the second opening 222. The controller 400 is connected to the first portion 224. Some structures of the controller 400 is located within the second portion 225. Therefore, when the handheld hair drying apparatus is damaged, the first portion 224, together with the controller 400, may be drawn out from inside the housing 210 so as to repair the controller 400, and the second portion 225 needs not to be drawn out.

In the present embodiment, as shown in FIG. 3, the handheld hair drying apparatus further includes a second end cover 250. The second end cover 250 is detachably connected to the second portion 225 such that external objects may be avoided from entering the tube body 220 through the second opening 222, thereby protecting the controller 400.

Specifically, the second portion 225 is provided with a connecting hole. One side of the second end cover 250 close to the second portion 225 is provided with a columnar convex. When the second end cover 250 is connected to the second portion 225, the columnar convex inserts into the connecting hole. In alternative embodiments, the second portion 225 may be detachably connected to the second end cover 250 in other ways such as buckling. Surely, in alternative embodiments, the second end cover 250 may also be detachably connected to the housing 210.

As shown in FIG. 3, at least part of the second end cover 250 extends from the second opening 222 into the second portion 225. A second fluid outlet 205 is formed between the second end cover 250 and an inner wall of the second portion 225. The second fluid outlet 205 communicates with the second opening 222. A confluence outlet 204 is formed between the second end cover 250 and an inner wall of the housing 210. The confluence outlet 204 communicates with the first fluid outlet 201 and the second fluid outlet 205. The arrangement of the second end cover 250 makes the fluid inside the first fluid channel 202 and the second fluid channel 203 converge and then flows out from the confluence outlet 204, such that the outflow of the handheld hair drying apparatus is evener, thereby improving user experience.

It's worth mentioning that in the present embodiment, as shown in FIG. 3, for convenience of user operation, a direction extending from the first end 110 to the second end 120 is perpendicular to that extending from the first opening 221 to the second opening 222, which means the handle 100 is perpendicular to the main body 200.

When the fluid inside the first fluid channel 202 flows from the handle 100 to the housing 210, the fluid firstly contacts with the first portion 224, then changes flowing direction. In order to improve flowing condition of the fluid inside the housing 210, as shown in FIG. 3, the first portion 224 is of horn shape, and the smaller end of the first portion 224 is connected to the second portion 225. In other words, contacting surface of the fluid with the first portion 224 is a curved surface. Therefore, angular variation of the flowing direction of the fluid after the fluid within the first fluid channel 202 contacts with the first portion 224 is reduced; connection point connecting the handle 100 and the housing 210 will be avoided from forming vacuum which may result in inner fluid circulation in the handle 100 and the housing, thereby avoiding energy loss for the fluid and reducing outflow rate of the handheld hair drying apparatus.

Furthermore, as shown in FIGS. 2-5, the main body 200 further includes a first flow-guiding element 260 arranged inside the first fluid channel 202 and connected to the first portion 224. The first flow-guiding element 260 is configured to guide the fluid inside the first fluid channel 202 to flow within the housing 210 along a direction extending from the first opening 221 to the second opening 222.

Specifically, the first flow-guiding element 260 includes a body 261, a first convex 262 and a second convex 263, the body 261 being connected to the first portion 224; the first convex 262 and the second convex 263 are arranged on a surface of the body 261 contacting with the fluid, the first convex 262 being opposite to the second convex 263.

When the fluid contacts with the body 261, some of the fluid flows along a direction towards the first convex 262, and the remaining fluid flows along a direction towards the second convex 263 because of the inhibition of the body 261. As shown in FIGS. 2-3, when the fluid contacts with the first convex 262, some of the fluid is inhibited by the first convex 262 and flows along a direction extending along the first opening 221 to the second opening 222, and the remaining fluid flows around the first portion 224 towards a direction away from the second end 120 after flowing over the first convex 262. Similarly, when the fluid contacts with the second convex 263, some of the fluid is inhibited by the second convex 263 and flows along a direction extending along the first opening 221 to the second opening 222, and the remaining fluid flows around the first portion 224 towards a direction away from the second end 120 after flowing over the second convex 263.

Therefore, the arrangement of the first flow-guiding element 260 may guide the fluid in the first fluid channel 202 to flow along the direction extending along the first opening 221 to the second opening 222, avoiding vacuum from forming at the connection connecting the handle 100 and the main body 200 which may form an inner fluid circulation inside the handle 100 and the main body 200, thereby avoiding fluid energy loss and reducing outflow rate of the handheld hair drying apparatus, and further avoiding a majority of the fluid from converging at a side of the first portion 224 away from the handle 100 for inertance, such that the outflow of the handheld hair drying apparatus is evener, improving user experience.

Furthermore, one end of the body 261 distal to the second end 120 bends along a direction from the first opening 221 to the second opening 222. In other words, contacting surface of the fluid with the body 261 is a curved surface. Therefore, angular variation of the flowing direction of the fluid after the fluid inside the first fluid channel 202 contacts with the body 261 is reduced, thereby avoiding energy loss for the fluid and reducing outflow rate of the handheld hair drying apparatus.

In the present embodiment, the first flow-guiding element 260 is fixed to the first portion 224 through a fastener. Furthermore, some structures of the first flow-guiding element 260 are clamped into the flow-guiding hole 223 and connected to the tube body 220, thereby avoiding moving the first flow-guiding element 260. It is to be understood that in alternative embodiments, the first flow-guiding element 260 may also be integrated with the first portion 224.

Furthermore, as shown in FIGS. 2 and 4, in order to avoid the fluid flowing around the first portion 224 from bumping at a side of the first portion 224 distal to the second end 120 and causes energy loss, the second main body 200 further includes a second flow-guiding element 270. The second flow-guiding element 270, opposite to the first flow-guiding element 260, is arranged on a side surface of the first portion 224 distal to the second end 120 for guiding the fluid inside the first fluid channel 202 to flow within the housing 210 along a direction extending from the first opening 221 to the second opening 222.

Furthermore, two second flow-guiding elements 270 are provided and arranged opposite to each other. Elements such as negative-ion generators may be arranged between the second flow-guiding elements 270 to make full use of the inner space of the housing 210.

In the present embodiment, the second flow-guiding element 270 and the first portion 224 are integrated as a whole. In alternative embodiments, the second flow-guiding element 270 may be separated from the first portion 224.

The disclosures described above are merely preferable embodiments, and should not be deemed as limiting the scope of the present application. Therefore, equivalent modifications based on the claims of the present application should also be deemed as falling into the scope of the present application.

What is claimed is:

1. A handheld hair drying apparatus, comprising:

a handle including a fluid inlet;

a main body including a housing, a tube body, a first end cover, and a second end cover; the housing is connected to the handle; the tube body passes through the housing coaxially and is connected to the housing; the tube body has a first opening and a second opening opposite to each other, the first end cover enclosing the first opening; a first fluid outlet is formed between an end of the tube body, where the second opening is located, and the housing, the first fluid outlet communicating with the fluid inlet to form a first fluid channel, the tube body is configured with a flow-guiding hole; the flow-guiding hole communicates with the second opening to form a second fluid channel, the second fluid channel communicating with the first fluid channel, the second end cover is connected to at least one of the tube body and the housing; at least part of the second end cover extends from the second opening to inside of the tube body, the second end cover and an inner wall of the tube body forming a second fluid outlet the second fluid outlet is commutated with the second opening; a confluence outlet is formed between the second end cover and an inner wall of the housing; the confluence outlet communicate with the first fluid outlet and the second fluid outlet;

a heater sheathing around the tube body and arranged between the flow-guiding hole and the second opening; and a controller arranged inside the tube body and covered by the first end cover.

2. The handheld hair drying apparatus of claim 1, wherein the first end cover is detachably connected to the tube body.

3. The handheld hair drying apparatus of claim 1, wherein the tube body includes a first portion and a second portion arranged coaxially, one end of the first portion connected to the housing, another end detachably connected to the second portion, wherein the one end of the first portion connected to the housing is provided with the first opening, an end of the second portion distal to the first portion is provided with the second opening.

4. The handheld hair drying apparatus of claim 3, wherein the first portion is of horn shape; a smaller end of the first portion is connected to the second portion.

5. The handheld hair drying apparatus of claim 1, wherein the second end cover is detachably connected to the tube body.

6. The handheld hair drying apparatus of claim 1, wherein the handle includes a first end and a second end arranged opposite to each other; the first end is provided with the fluid inlet, the second end connected to the housing, a direction extending from the first end to the second end being perpendicular to that extending from the first opening to the second opening.

7. The handheld hair drying apparatus of claim 6, wherein the main body further includes a first flow-guiding element located within the first fluid channel and connected to the tube body; the first flow-guiding element is configured to guide the fluid inside the first fluid channel to flow from the first opening to the second opening within the housing.

8. The handheld hair drying apparatus of claim 7, wherein the first flow-guiding element includes a body, a first convex and a second convex, the body being connected to the tube body; the first convex and the second convex are arranged on the body, the first convex being opposite to the second convex.

9. The handheld hair drying apparatus of claim 8, wherein one end of the body distal to the second end bends along a direction from the first opening to the second opening.

10. The handheld hair drying apparatus of claim 7, wherein the main body further includes a second flow-guiding element; the second flow-guiding element is arranged on another side of the tube body relative to the second end; the second flow-guiding element is configured to guide the fluid inside the first fluid channel to flow from the first opening to the second opening within the housing.

11. The handheld hair drying apparatus of claim 10, wherein two second flow-guiding elements are provided and arranged opposite to each other.

* * * * *